United States Patent [19]

Belfi

[11] Patent Number: 4,736,825

[45] Date of Patent: Apr. 12, 1988

[54] COMBINATION TOTE BAG AND BODY REST

[76] Inventor: Daniel P. Belfi, 12311 SW. 94th La., Miami, Fla. 33186

[21] Appl. No.: 886,024

[22] Filed: Jul. 15, 1986

Related U.S. Application Data

[63] Continuation-in-part of Ser. No. 723,176, Apr. 15, 1985, abandoned.

[51] Int. Cl.[4] ..... A45G 7/00; A45G 9/00

[52] U.S. Cl. ..... 190/8; 5/417; 383/4

[58] Field of Search ..... 5/417, 418, 419, 420; 383/4; 190/1, 2, 8

[56] References Cited

U.S. PATENT DOCUMENTS

| | | | |
|---|---|---|---|
| 2,816,599 | 12/1957 | Adams | 190/8 |
| 2,915,154 | 12/1959 | Holder | 383/4 X |
| 3,822,424 | 7/1974 | Messer | 5/419 |
| 4,194,601 | 3/1980 | Yellin | 190/8 X |
| 4,273,221 | 6/1981 | Poag | 190/8 |
| 4,466,517 | 8/1984 | Spiegelman | 383/4 X |

FOREIGN PATENT DOCUMENTS

| | | | |
|---|---|---|---|
| 504701 | 4/1939 | United Kingdom | 383/4 |

*Primary Examiner*—William Price
*Attorney, Agent, or Firm*—Malin, Haley & McHale

[57] ABSTRACT

A combination tote bag and body rest comprising first and second frame sections. The second frame section is hingeably secured to the first frame section with both frame sections being collapsible from an expanded lean-to position to a collapsed transport position. The first and second frame sections provide the support for the body rest when the unit is in the lean-to position and placed upon a support surface. The first frame section includes a body rest surface placed within, and secured to, the frame. A collapsible bag is secured to the first and second frame sections and positioned therebetween. The bag is in an expanded position when the frame sections are in the lean-to position, and the bag is collapsed when the frame sections are collapsed. The bag is made of a pliable material and lightweight to facilitate transportation. The bag includes means for opening and closing the bag, the interior of the bag being accessible simultaneous to a person utilizing the body rest. The bag is accessible either by the person resting on the unit or by another person. Finally, the unit includes a seat portion which is secured along one edge to the first frame section and movable thereabout. The seat section provides a protective barrier between the person utilizing the rest and the surface therebeneath.

4 Claims, 1 Drawing Sheet

COMBINATION TOTE BAG AND BODY REST

This application is a continuation-in-part of Ser. No. 723,176, filed Apr. 15, 1985, now abandoned, entitled Combination Beach Tote and Rest.

BACKGROUND OF THE INVENTION

The subject matter relates to a combination tote bag and body rest, and more particularly to a combination tote bag and body rest having a pliable, collapsible tote bag integrally associated with the collapsible frame members.

Combination bags and rests have been known in the art, such as those disclosed in Poag—U.S. Pat. No. 4,273,221 and Spiegelman—U.S. Pat. No. 4,466,517. Poag discloses a combination valise and backrest, which is a rigid mechanical structure housing an interior compartment and seatrest. Spiegelman discloses a top opening tote bag and body rest, made of pliable material including a seat portion.

Neither of these devices, however, teach or suggest a device which can be used simultaneously as a body rest and accessible tote bag. That is, when a person is utilizing these devices, the interior of the tote bag is inaccessible. This is a common characteristic of the art in this area.

It is therefore highly desirable to provide a combination tote bag and body rest which is collapsible, lightweight, and facilitates transportation of a large number of items yet provides a structurally sound body rest.

It is also highly desirable to provide a combination tote bag and body rest which is cost effective yet maintains structural integrity.

It is also highly desirable to provide a combination tote bag and body rest which contains a collapsible, pliable bag integrally associated with the support structure and frame members of the body rest.

It is also highly desirable to provide a combination tote bag and body rest which provides a tote bag which is simultaneously accessible while a person is utilizing the body rest, said tote bag being accessible either from the person utilizing the body rest or a second party.

It is also highly desirable to provide a combination tote bag and body rest wherein the body is accessible without the person leaving the seat of the body rest.

It is also highly desirable to provide a combination tote bag and body rest which will facilitate a large number of items in an expanded position, yet collapses to a relatively small, lightweight and unobtrusive size.

Finally, it is highly desirable to provide a combination tote bag and body rest having all of the above mentioned features.

SUMMARY OF THE INVENTION

It is therefore an object of the invention to provide a combination tote bag and body rest which is collapsible, lightweight, and facilitates transportation of a large number of items yet provides a structurally sound body rest.

It is also an object of the invention to provide a combination tote bag and body rest which is cost effective yet maintains structural integrity.

It is also an object of the invention to provide a combination tote bag and body rest which contains a collapsible, pliable bag integrally associated with the support structure and frame members of the body rest.

It is also an object of the invention to provide a combination tote bag and body rest which provides a tote bag which is simultaneously accessible while a person is utilizing the body rest, said tote bag being accessible either from the person utilizing the body rest or a second party.

It is also an object of the invention to provide a combination tote bag and body rest wherein the bag is accessible without the person leaving the seat of the body rest.

It is also an object of the invention to provide a combination tote bag and body rest which will facilitate a large number of items in an expanded position, yet collapses to a relatively small, lightweight and unobtrusive size.

Finally, it is an object of the invention to provide a combination tote bag and body rest having all of the above mentioned features.

Briefly, what is provided is a combination tote bag and body rest, comprising first and second frame sections. The second frame section is hingeably secured to the first frame section with both frame sections being collapsible from an expanded lean-to position to a collapsed transport position. The first and second frame sections provide the support for the body rest when the unit is in the lean-to position and placed upon a support surface. The first frame section includes a body rest surface placed within, and secured to, the frame. A collapsible bag is secured to the first and second frame sections and positioned therebetween. The bag is in an expanded position when the frame sections are in the lean-to position, and the bag is collapsed when the frame sections are collapsed. The bag is made of a pliable material and lightweight to facilitate transportation. The bag includes means for opening and closing the bag, the interior of the bag being accessible simultaneous to a person utilizing the body rest. The bag is accessible either by the person resting on the unit or by another person. Finally, the unit includes a seat portion which is secured along one edge to the first frame section and movable thereabout. The seat section provides a protective barrier between the person utilizing the rest and the surface therebeneath.

BRIEF DESCRIPTION OF THE DRAWINGS

The above mentioned and other features and objects of this invention and the manner of obtaining them will become more apparent and the invention itself will become best understood by reference to the following description of the embodiment of the invention taken in conjunction with the accompanying drawings, wherein.

DESCRIPTION OF THE PREFERRED EMBODIMENT

Figure 1:
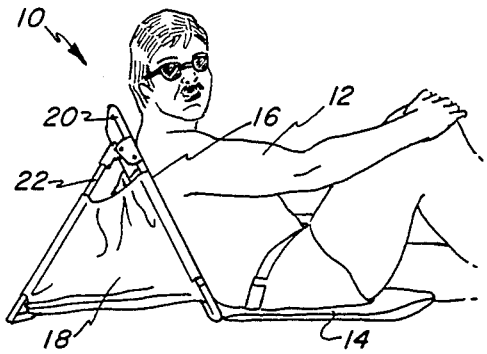
FIG. 1 is a perspective view of an embodiment of the invention illustrating its use.

Referring now to FIG. 1, the combination tote bag and body rest 10 is shown. In an expanded position, a user 12 rests upon seat portion 14 and body rest surface 16. The collapsible tote bag 18 is shown interposed first frame section 20 and second frame section 22. The details of the above referenced structure will be further described hereinafter.

Figure 2:
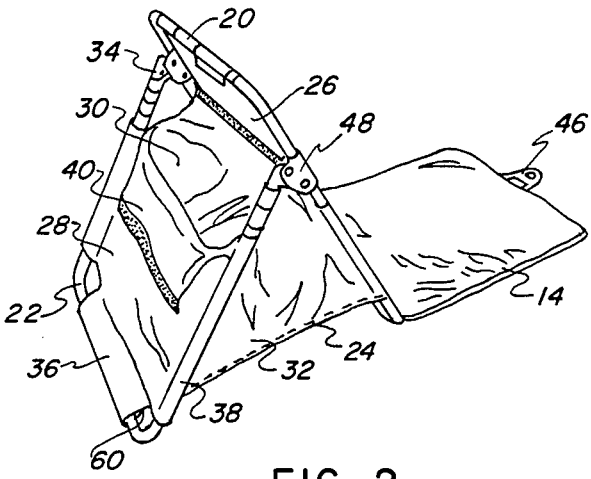
FIG. 2 is a perspective view of the invention illustrating the body rest, tote bag and seat.

Referring now to FIG. 2, tote bag 18 is shown having a bottom 24, a first side 26, a second side 28, a third side 30 and a fourth side 32. Second side 28 is securely attached to second frame section 22. Second frame section 22 includes three separate segments 34, 36 and 38, these three segments being generally rectangular in shape with one open side. As shown, segments 34 and 38 are attached at the open end by hingeable means 48 to first frame section 20. Tote bag 18 is also shown having flap 40 which provides a means for opening and closing tote bag 18 and protecting the contents therein.

The invention is shown in FIG. 2 in an expanded condition, ready for use by a person resting on the unit, for inserting or removing items from the tote bag.

In operation, the invention can be collapsed by rotating the second frame section 22 in the direction of arrow 42 towards first frame section 20. As this rotation occurs, tote bag 18 is likewise collapsed, as tote bag 18 is made of a flexible, pliable material and generally conforms to a shape dependent upon the positioning of the associated frame members. However, if tote bag 18 contains items placed therein, the invention can still be collapsed as the pliable material of the bag will then conform to the exterior boundaries defined by the items placed within the bag.

To finally collapse the unit, seat 14 is rotated upward in the direction of arrow 44, also towards first frame section 20 and secured thereto via Velcro strip 46 or a similar manner of attachment.

Flap 40 is shown utilizing Velcro strips to attach the flap to the opposite side of the collapsible tote bag, as well as used to secure seat 14 to first frame section 20. However, it is to be clearly understood that any equivalent attaching means can be utilized which includes snaps, hooks, latches or buttons and the like. Similarly, a variety of hingeable means 48 can be utilized to hingeably secure first frame section 20 to second frame section 22. The particular type of hinge utilized is irrelevant as long as pivotal motion is provided.

Figure 3:
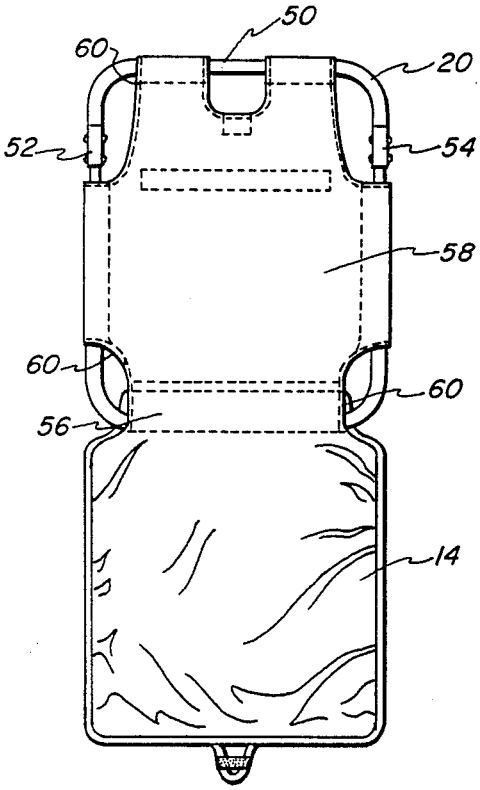
FIG. 3 is a front view of the invention illustrating the body rest surface and the seat portion.

Referring now to FIG. 3, a front view of the invention is illustrated. First frame section 20 is shown comprised of four individual segments 50, 52, 54, and 56. First frame section 20 is thus generally rectangular in shape.

Seat portion 14 is secured to surface contacting segment 56 of first frame section 20. As is apparent from FIGS. 2 and 3, first frame section 20 and second frame section 22 each contain one segment which is a surface contacting segment, specifically segments 36 and 56 respectively.

As illustrated in FIG. 2, the body rest structure of the invention is generally a "lean-to" structure. In an expanded position the second frame section 22 is rotated outwardly and stabilized by hinge means 48 to first frame section 20. This lean-to structure provides a stable support when said surface contacting segments rest upon a support structure. This lean-to, or generally triangular shape, has proven to be simple in design yet structurally sound.

Body rest surface 58 provides the means for a person to rest upon the invention while sitting upon seat 14. Body rest surface 58 is in actuality the exterior surface of first side 26 of collapsible bag 18. Thus, side 26 of the tote bag and body rest surface 58 are one and the same, further providing an efficient design.

As shown in FIGS. 2 and 3, the sides of the collapsible tote bag are secured to the corresponding frame structure utilizing a loop and insert assembly. That is, the sides of the bags are sewn and provided with loops 60, through which the corresponding frame structure of the first or second frame members are positioned. The loops are dimensioned such that when the frame structures are placed therethrough, a flexible yet taut bag is provided.

As is apparent to those skilled in the art, alternative securing means could be utilized when attaching the sides of the bag 18 to the associated frame structure.

Figure 4:
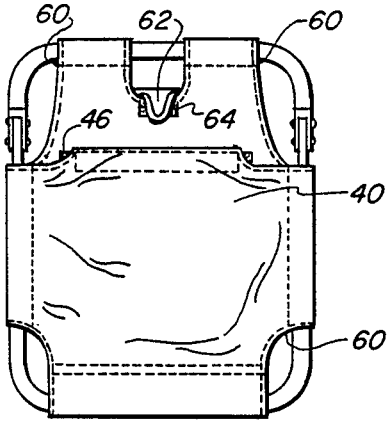
FIG. 4 is a rear view of the invention illustrating the tote bag in the closed position.

Referring now to FIG. 4, a rear view of the invention is shown. For purposes of clarity, loops 60 again illustrate the placement of the collapsible bag over the associated frame structure. This view illustrates how flap 40 is used to close collapsible bag 18 and protect the contents therein. As shown Velcro strips 46 are used to attach the flap to the opposite side of the bag.

Also illustrated in FIG. 4 is the means for transporting the combination tote bag and body rest via means for carrying 62. In this embodiment the means for carrying is merely a handle which is provided by eliminating a portion of the material from the first side of the bag and creating a void 64 therein. Thus the placement of the hand through void 64 and around the first frame section at point 62 provides a handle for carrying the unit.

Figure 5:
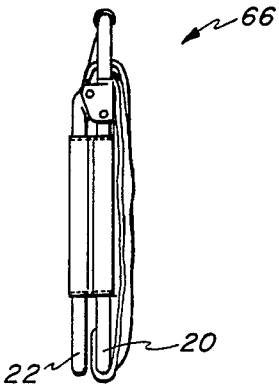
FIG. 5 is a perspective view illustrating the combination tote bag and body rest in a completely collapsed position and ready for transport.

Referring now to FIG. 5, the invention is shown in a collapsed condition 66. As illustrated, second frame section 22 is rotated inward to a position immediately adjacent to first frame section 20. Seat 14 is rotated upward towards the top of first frame section 20 and also rests immediately adjacent thereto. Flexible, pliable material of the bag 18 is such that it can be folded up and occupy a relatively small area between the first and second frame sections described above. As illustrated, the tote bag in its collapsed position provides a relatively small, lightweight, and easily transported unit.

Should items be placed within the tote bag during transportation, the invention would merely take the shape of a conventional bag in the sense of carrying a bag having a rigid support fame.

While there have been described above the principles of this invention in connection with specific apparatus, it is to be clearly understood that this description is made only by way of example and not as a limitation to the scope of the invention.

What is claimed is:

1. A combination tote bag and body rest, comprising:

first and second frame sections, said second fame section hingeably secured to said first frame section, said first and second frame sections collapsible from an expanded lean-to position to a collapsed transport position;

said first and second frame sections providing the support for said body rest when in said lean-to position and placed upon a support surface;

said first frame section including a body rest surface placed within, and secured thereto;

said first frame section being generally rectangular in shape having four segments comprising said first frame section, said second frame section having three segments in a generally rectangular shape with one end open, said second frame section hingeably secured at said open end to said first frame section, one segment of each of said first and second frame sections being a surface contacting segment when said body rest is in said lean-to position upon a support surface;

a collapsible bag, said bag having a first side secured to said first frame section and a second side secured to said second frame section, said bag positioned between said first and second frame sections, said bag being expanded when said first and second frame sections are in said lean-to position, and being collapsed when said first and second frame sections are collapsed;

said bag including means for opening and closing said bag, the interior of said bag being accessible simultaneous to a person utilizing said body rest, said bag being accessible either by said person or another person;

said bag comprising a bottom and four sides, said bottom attached at opposite ends to said surface contacting segments of said first and second frame sections, a first side of said bag being said body rest surface of said first frame section, a second side being generally coplanar with said second frame section and securely attached thereto, said third and fourth sides secured at opposite ends to said first and second sides, and secured along one edge to said bottom; and a seat portion, said seat portion being secured along one side to said first frame section and selectively moveable thereabout.

2. The apparatus of claim 1 wherein:

said means for opening and closing said bag comprises a flap, said flap being a portion of said second side of said bag, said flap releasably attached to said first side of said bag.

3. The apparatus of claim 1 wherein:

said means for opening and closing said bag comprises a zipper positioned in said second side of said bag.

4. A combination tote bag and body rest, comprising:

first and second frame sections, said second frame section hingeably secured to said first frame section, said first frame section generally rectangular and comprised of four segments, said second frame section having three segments generally rectangular in shape with one end open, said second section hingeably secured at said open end to said first frame section, one segment of each of said first and second frame sections being a surface contacting segment, said first and second frame sections collapsible from an expanded lean-to position to a collapsed transport position, said first and second frame sections providing the support for said body rest when in said lean-to position and placed upon a support surface, said first frame section including a body rest surface placed within, and secured thereto;

a collapsible bag, said bag being secured to said first and second frame sections and positioned therebetween, said bag being pliable and expanded when said first and second frame sections are in said lean-to position, and said bag being collapsible when said first and second frame sections are collapsed, said bag including means for opening and closing said bag, the interior of said bag being accessible simultaneous to a person utilizing said body rest;

said bag being accessible either by said person or another person, said bag comprising a bottom and four sides, said bottom attached at opposite ends to said surface contacting segments of said first and second frame sections, a first side of said bag being said body rest surface of said first frame section, a second side being generally coplanar with said second frame section and securely attached thereto, said third and fourth sides secured at opposite ends to said first and second sides, and secured along one end to said bottom side of said bag;

said means for opening and closing said bag comprising a flap, said flap being a portion of said second side of said bag, said flap releasably attached to said first side of said bag;

a seat portion, said seat portion being secured at one side to said surface contacting segment of said first frame section, and selectively movable thereabout; and means for carrying said tote bag when said tote bag and said body rest are in said collapsed position, said tote bag and said body rest providing an integral unit for transporting items.

* * * * *